US011713534B2

(12) United States Patent
Curiel et al.

(10) Patent No.: US 11,713,534 B2
(45) **Date of Patent: *Aug. 1, 2023**

(54) BUTTON TRAP AND SIEVE FOR A LAUNDRY APPLIANCE

(71) Applicant: WHIRLPOOL CORPORATION, Benton Harbor, MI (US)

(72) Inventors: Joao P. Curiel, Sao Paulo (BR); Dennis Kehl, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/699,277

(22) Filed: Mar. 21, 2022

(65) Prior Publication Data

US 2022/0205164 A1 Jun. 30, 2022

Related U.S. Application Data

(63) Continuation of application No. 16/574,834, filed on Sep. 18, 2019, now Pat. No. 11,319,659.

(60) Provisional application No. 62/785,904, filed on Dec. 28, 2018.

(51) Int. Cl.

| | |
|---|---|
| ***D06F 39/10*** | (2006.01) |
| ***D06F 21/02*** | (2006.01) |
| ***D06F 39/08*** | (2006.01) |
| ***D06F 103/42*** | (2020.01) |
| ***D06F 105/34*** | (2020.01) |
| *D06F 43/08* | (2006.01) |

(52) U.S. Cl.

CPC ..... *D06F 39/10* (2013.01); *D06F 21/02* (2013.01); *D06F 39/083* (2013.01); *D06F 43/085* (2013.01); *D06F 2103/42* (2020.02); *D06F 2105/34* (2020.02)

(58) Field of Classification Search

CPC ..... D06F 21/02; D06F 39/083; D06F 39/085; D06F 39/10; D06F 43/085; D06F 2103/42; D06F 2105/34

See application file for complete search history.

(56) References Cited

U.S. PATENT DOCUMENTS

| | | | |
|---|---|---|---|
| 2,512,394 | A | 6/1950 | Sullivan |
| 3,228,525 | A | 1/1966 | Evans et al. |
| 3,727,435 | A | 4/1973 | Menk |
| 3,774,418 | A | 11/1973 | Ohmann |
| 3,847,812 | A | 11/1974 | Ohmann |
| 3,977,218 | A | 8/1976 | Zucchini |
| 3,977,219 | A | 8/1976 | Bochan |
| 4,485,645 | A | 12/1984 | Mulder et al. |

(Continued)

FOREIGN PATENT DOCUMENTS

| | | |
|---|---|---|
| CA | 2345190 | 1/2002 |
| CN | 107287846 | 10/2017 |

(Continued)

*Primary Examiner* — Joseph L. Perrin

(74) *Attorney, Agent, or Firm* — Price Heneveld LLP

(57) ABSTRACT

A laundry appliance includes a wash tub disposed within a cabinet. A rotating drum is disposed within the wash tub. A drain system directs a fluid from the wash tub to a fluid pump. A trap is disposed within a tub drain of the wash tub. The trap includes an elongated body having a plurality of fingers that extend across an aperture defined within the elongated body. The plurality of fingers are configured to permit passage of particulate material and prevent passage of foreign objects through the elongated body.

20 Claims, 8 Drawing Sheets

(56) References Cited

U.S. PATENT DOCUMENTS

| | | | |
|---|---|---|---|
| 4,833,900 | A | 5/1989 | Babuin et al. |
| 5,120,434 | A | 6/1992 | Yoshida |
| 5,437,789 | A | 8/1995 | Sabo et al. |
| 5,827,423 | A | 10/1998 | Lee |
| 9,422,661 | B2 | 8/2016 | Mantle et al. |
| 9,528,217 | B2 | 12/2016 | Tian et al. |
| 9,976,247 | B2 | 5/2018 | Cinello et al. |
| 2003/0209041 | A1 | 11/2003 | Thies et al. |
| 2004/0129034 | A1 | 7/2004 | Zanello et al. |
| 2005/0120758 | A1 | 6/2005 | Thies et al. |
| 2005/0246843 | A1 | 11/2005 | Song et al. |
| 2007/0240457 | A1 | 10/2007 | Jang et al. |
| 2010/0251777 | A1 | 10/2010 | Komoto et al. |
| 2011/0048078 | A1 | 3/2011 | Tobi et al. |
| 2011/0100071 | A1 | 5/2011 | Mazzon et al. |
| 2012/0125056 | A1 | 5/2012 | Bondi et al. |
| 2012/0186303 | A1 | 7/2012 | Kim et al. |
| 2013/0074554 | A1 | 3/2013 | Chun et al. |
| 2013/0125596 | A1 | 5/2013 | Ushijima et al. |
| 2013/0276484 | A1 | 10/2013 | Mantle et al. |
| 2014/0083145 | A1 | 3/2014 | Bondi |
| 2014/0238089 | A1 | 8/2014 | Jeong et al. |
| 2017/0101733 | A1 | 4/2017 | Jung et al. |
| 2017/0101734 | A1 | 4/2017 | Jung et al. |
| 2017/0218547 | A1 | 8/2017 | Lv et al. |
| 2017/0233938 | A1 | 8/2017 | Hwang et al. |

FOREIGN PATENT DOCUMENTS

| | | |
|---|---|---|
| EP | 1593768 | 11/2005 |
| EP | 2455355 | 5/2012 |
| JP | 2005192920 | 7/2005 |
| JP | 2006149615 | 6/2006 |

BUTTON TRAP AND SIEVE FOR A LAUNDRY APPLIANCE

CROSS-REFERENCE TO RELATED APPLICATION

The present application is a continuation of U.S. patent application Ser. No. 16/574,834 filed Sep. 18, 2019, now U.S. Pat. No. 11,319,659, entitled BUTTON TRAP AND SIEVE FOR A LAUNDRY APPLIANCE, which claims priority to and the benefit under 35 U.S.C. § 119(e) of U.S. Provisional Patent Application No. 62/785,904, filed on Dec. 28, 2018, entitled BUTTON TRAP AND SIEVE FOR A LAUNDRY APPLIANCE, the entire disclosures of which are hereby incorporated herein by reference.

FIELD OF THE DEVICE

The device is in the field of laundry appliances, and more specifically, a laundry appliance having a button trap and sieve that capture foreign objects and also allows for the passage of fine particulate material and lint particles therethrough.

SUMMARY

According to one aspect of the present disclosure, a laundry appliance includes a wash tub disposed within a cabinet. A rotating drum is disposed within the wash tub. A drain system directs a fluid from the wash tub to a fluid pump. A trap is disposed within a tub drain of the wash tub. The trap includes an elongated body having a plurality of fingers that extend across an aperture defined within the elongated body. The plurality of fingers are configured to permit passage of particulate material and prevent passage of foreign objects through the elongated body.

According to another aspect of the present disclosure, a laundry appliance includes a wash tub disposed within a cabinet and having a rotating drum positioned therein. A drain system directs a fluid from the wash tub to a fluid pump. A tub drain directs fluid from the wash tub to a fluid pump system. A foreign-object trap is disposed within the tub drain. The foreign-object trap includes an elongated body and a plurality of fingers that extend in a direction of a flow of fluid through the foreign-object trap. The plurality of fingers are configured to permit passage of particulate material toward the pump system and prevent passage of foreign objects through the elongated body.

According to yet another aspect of the present disclosure, a laundry appliance includes a wash tub disposed within a cabinet and having a rotating drum positioned therein. A drain system directs a fluid from the wash tub to a fluid pump. A tub drain that directs fluid from the wash tub to a fluid pump system. A foreign-object trap is disposed within the tub drain. The foreign-object trap includes an elongated body and a plurality of apertures that permit passage of particulate material toward the pump system and prevent passage of foreign objects through the elongated body. The elongated body defines a flow restriction space that permits upward movement of air as fluid moves through the plurality of apertures and toward the fluid pump system.

These and other features, advantages, and objects of the present device will be further understood and appreciated by those skilled in the art upon studying the following specification, claims, and appended drawings.

DETAILED DESCRIPTION OF EMBODIMENTS

Figure 1:
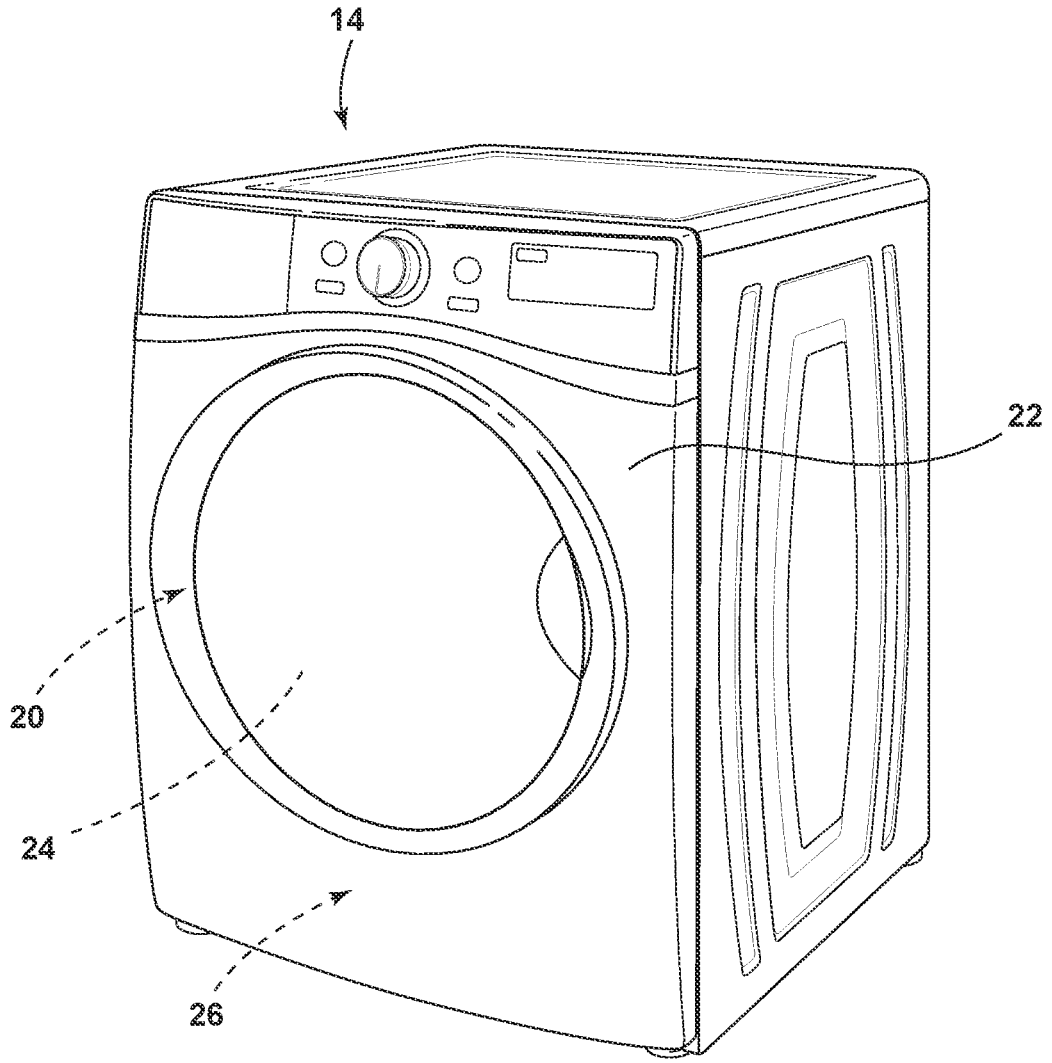
FIG. 1 is a front perspective view of a laundry appliance that incorporates an aspect of the button trap.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1 and 3-8, reference numeral 10 generally refers to a button trap or foreign-object trap that can be incorporated within a trap housing 12 for an appliance 14. The button trap 10 is configured to capture and retain foreign objects 16 such as buttons, coins, caps, and other foreign objects 16 that are often left within clothing being laundered. Simultaneously, the button trap 10 is configured to allow for the substantially free passage of fine particulate material 18, such as lint particles, therethrough. According to the various aspects of the device, the laundry appliance 14 includes a wash tub 20 that is configured within a cabinet 22. A rotating drum 24 is disposed within the wash tub 20. A fluid pump system or drain system 26 is included within the appliance 14 and directs fluid 28 from the tub 20 and to at least one fluid pump 30. A trap, typically in the form of a button trap 10, is disposed within a tub drain 32 of the wash tub 20. The button trap 10 typically includes an elongated body 34 having a plurality of fingers 36 that extend across an aperture 38 defined within the elongated body 34.

As shown within FIG. 1, the laundry appliance 14 can typically be in the form of a horizontal axis laundry appliance 14. This laundry appliance 14 can include the tub 20 that is generally oriented in a horizontal configuration or a sloped configuration. It should be understood that other types of laundry appliances 14 can use the button trap 10 disclosed herein. The rotating drum 24 rotationally operates within the wash tub 20, where the rotating drum 24 operates to agitate laundry being processed therein. During operation of the laundry appliance 14, fluid 28 in the form of water and various laundry chemistries are disposed within the tub 20 and the rotating drum 24.

Figure 2:
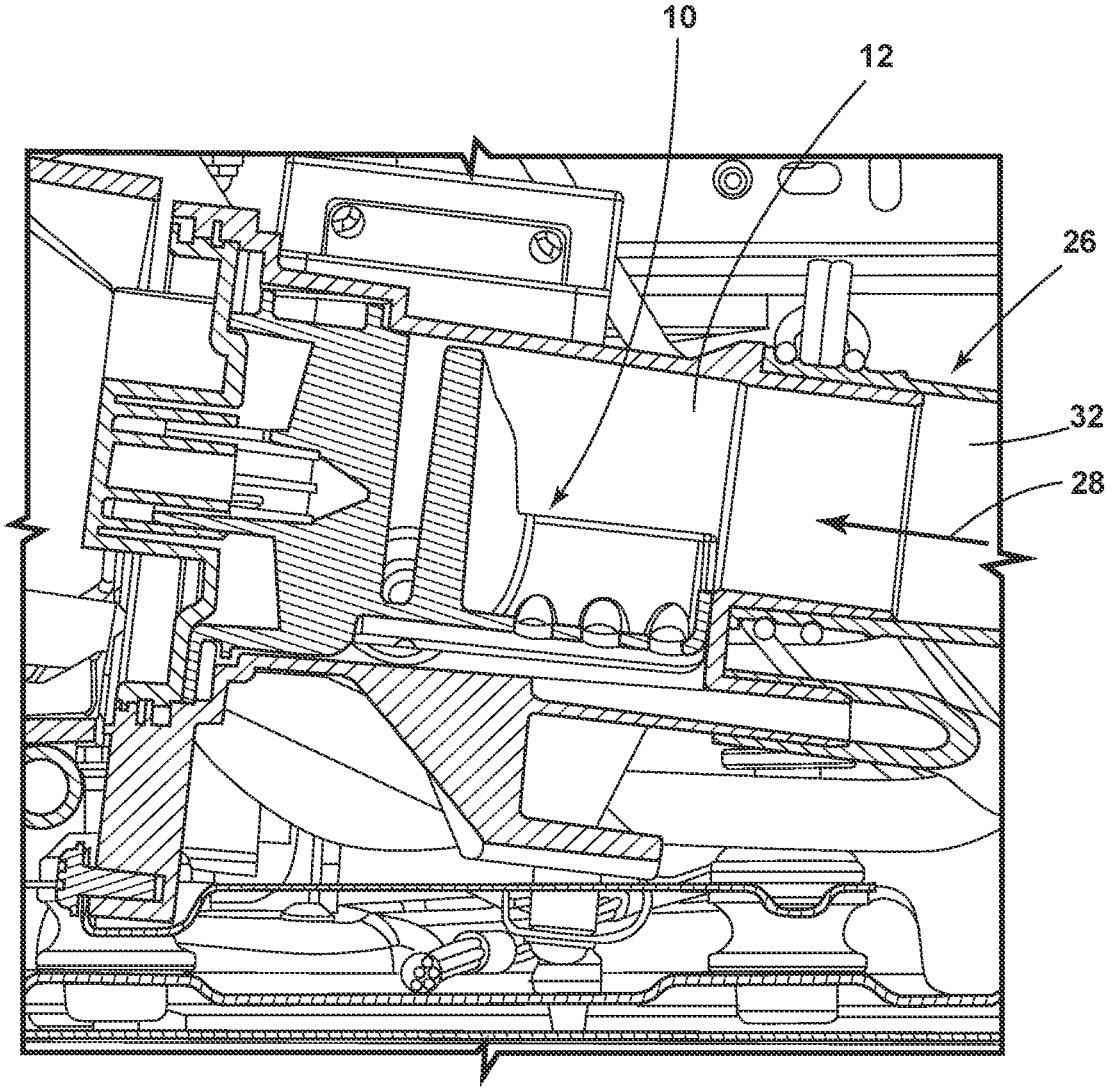
FIG. 2 (PRIOR ART)
FIG. 2 is a cross-sectional view of a prior art trap housing that incorporates a conventional button trap therein.
Figure 3:
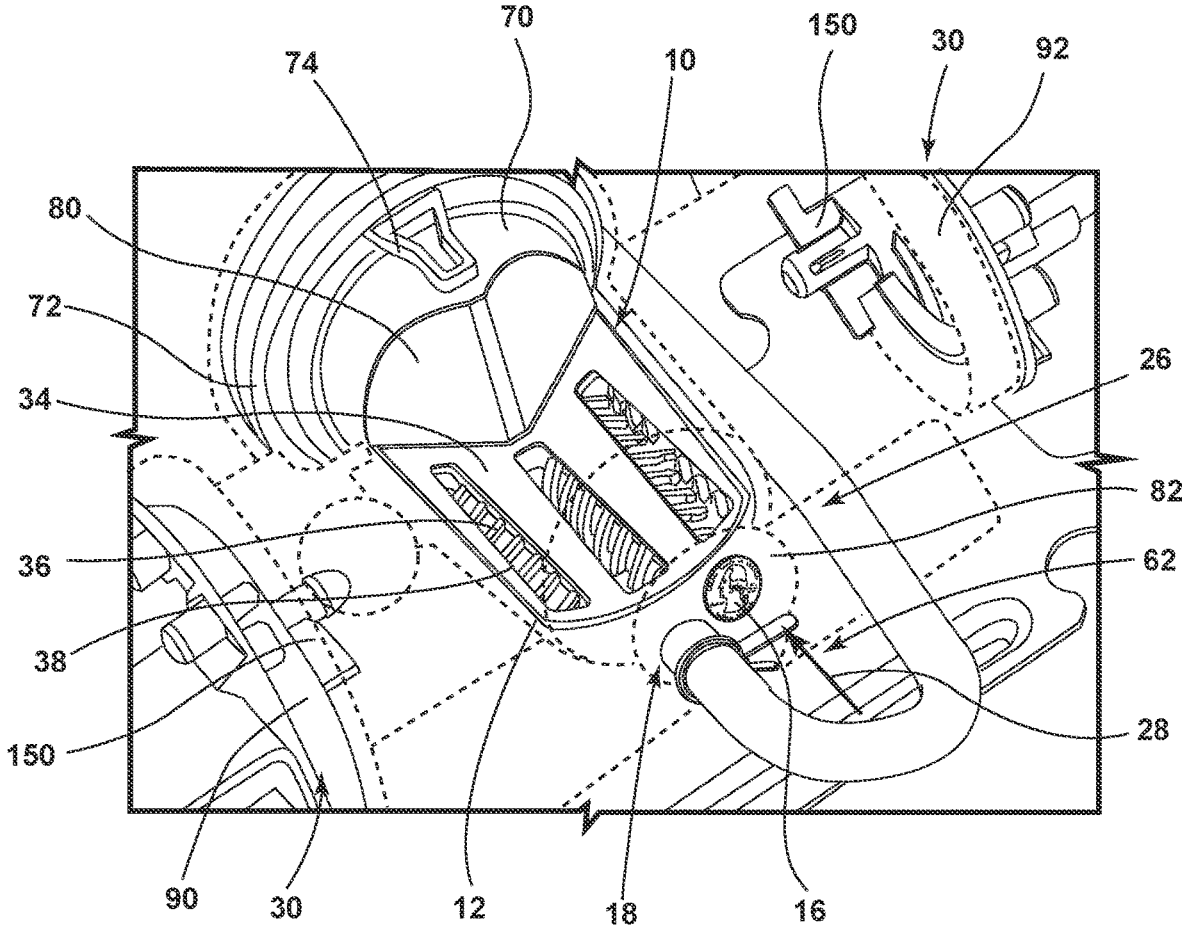
FIG. 3 is a cross-sectional perspective view of a trap housing that incorporates an aspect of the button trap that includes a plurality of elongated fingers.
Figure 4:
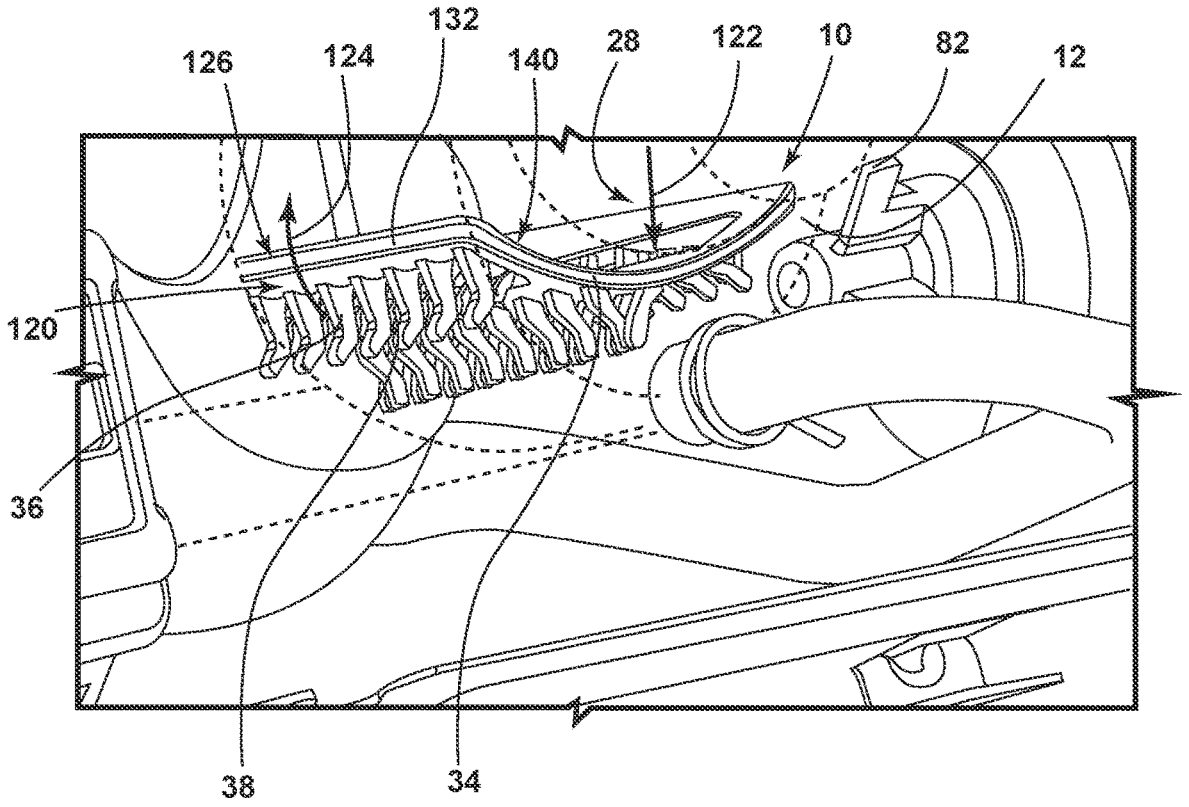
FIG. 4 is another cross-sectional perspective view of the trap housing of FIG. 3 showing an aspect of the button trap incorporated therein.

As exemplified in the prior art image of FIG. 2, during various stages of a particular wash cycle, the fluid 28 contained within the tub 20 and the rotating drum 24 is drained therefrom during various stages of a laundry cycle. This drained fluid 28 is directed through the tub drain 32. Foreign objects 16 that are entrapped within this fluid 28 being drained from the tub 20 can include items, similar to those described above. The button trap 10 contained therein is configured to prevent passage of these foreign objects 16. These foreign objects 16, being solid and typically larger in size, can cause damage to one or more pumps 30 that are located downstream of the trap housing 12 and the button trap 10. At the same time, fine particulate material 18 captured within the fluid 28 leaving the drum 24 is allowed to pass through the trap housing 12 and the fingers 36 of the button trap 10. This particulate material 18 is configured to be conveniently processed by the one or more fluid pumps 30 during operation of the appliance 14. These pumps 30 are typically designed to process and allow passage of this particulate material 18.

Referring again to FIGS. 3-8, the button trap 10 includes the plurality of fingers 36 that typically extend across a centerline 50 of the aperture 38. In various aspects of the device, the button trap 10 can include a plurality of apertures 38 that extend through the elongated body 34. The orientation of these various apertures 38 can be utilized for directing fluid 28 in a particular direction, such as toward a particular fluid pump 30 within the appliance 14. Within each of the apertures 38 of the elongated body 34, the fingers 36 can include opposing sets 52 of fingers 36 that each extend across the centerline 50 of the aperture 38. In this manner, the elongated fingers 36 can form a generally overlapping structure that can be used to prevent the passage of foreign objects 16. At the same time, fine particulate material 18 captured within the fluid 28 leaving the drum 24 is allowed to pass through the trap housing 12 and the fingers 36 of the button trap 10. This particulate material 18 is configured to be conveniently processed by the one or more fluid pumps 30 during operation of the appliance 14.

As exemplified in FIGS. 3-8, the plurality of fingers 36 are adapted to extend in a generally angular direction 60 that follows the flow 62 of fluid 28 therethrough. Through this configuration, the flow 62 of fluid 28 through the fingers 36 typically engages an angled or arcuate surface 64 of each of the elongated fingers 36. These angled or arcuate surfaces 64 of the various fingers 36 allows lint to conveniently slide off of the fingers 36 and proceed downstream of the trap housing 12 and toward the various pumps 30 of the appliance 14.

Figure 6:
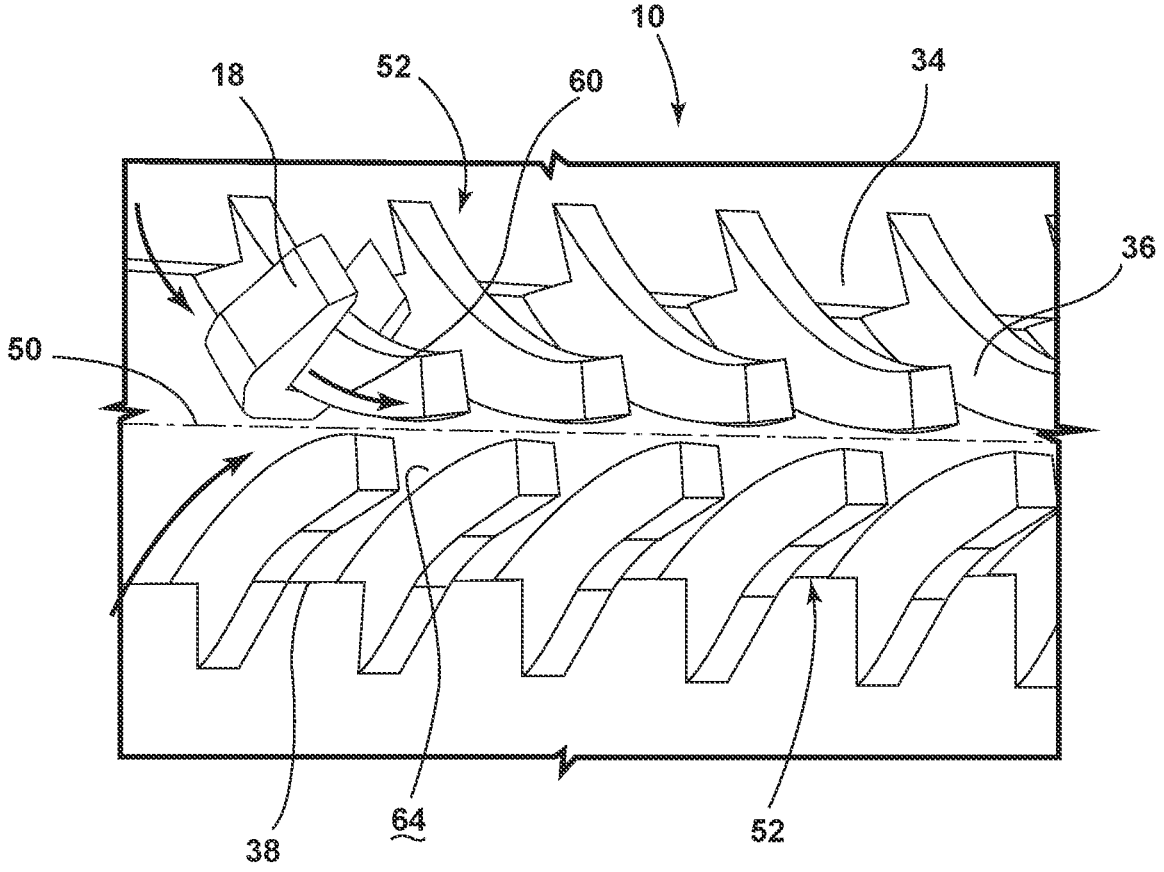
FIG. 6 is a schematic perspective view of the elongated fingers of the button trap and showing a flow of fluid through the elongated fingers that allows for the passage of lint particles.
Figure 7:
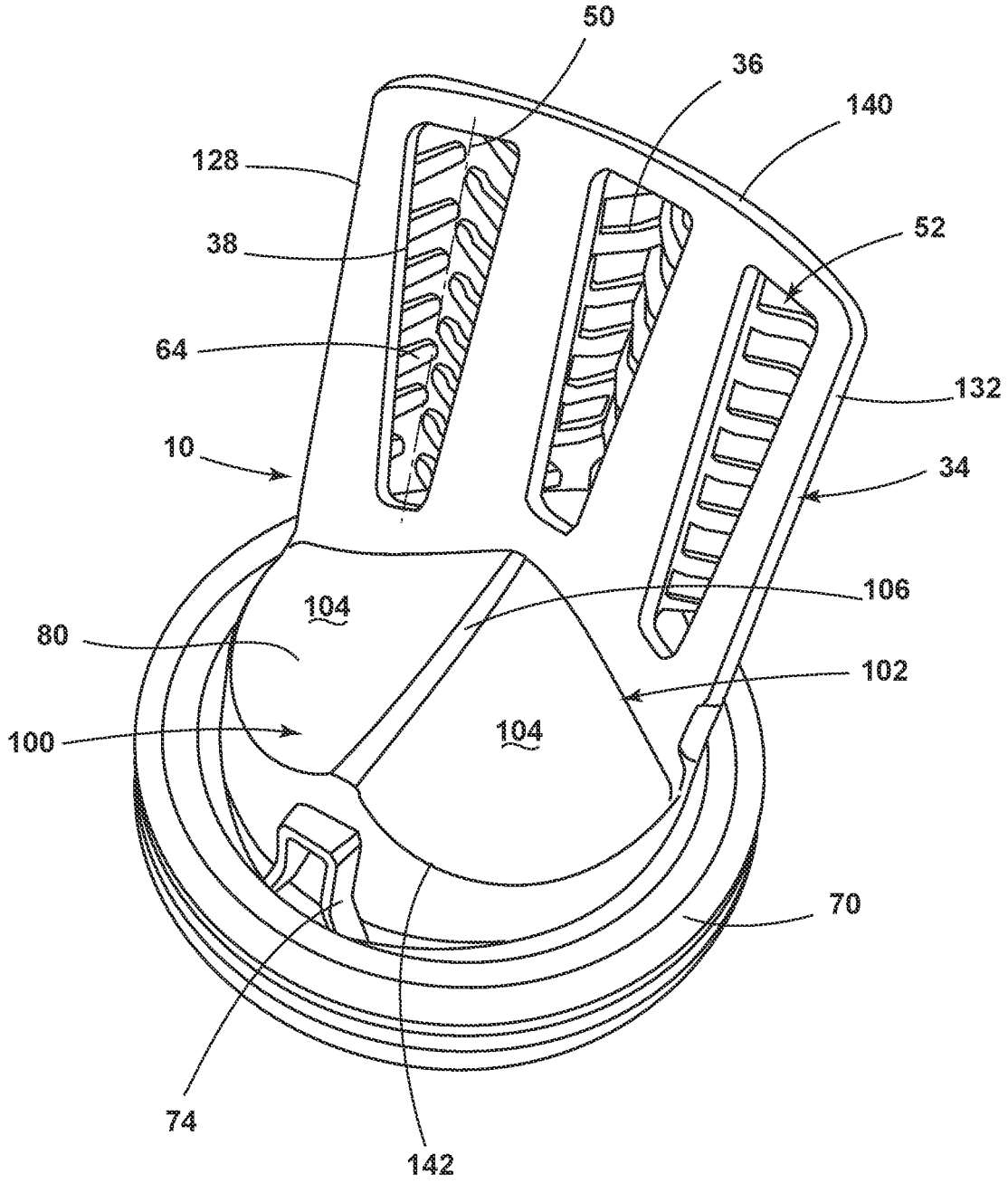
FIG. 7 is a perspective view of an aspect of the button trap that can be incorporated within the trap housing for the appliance.
Figure 8:
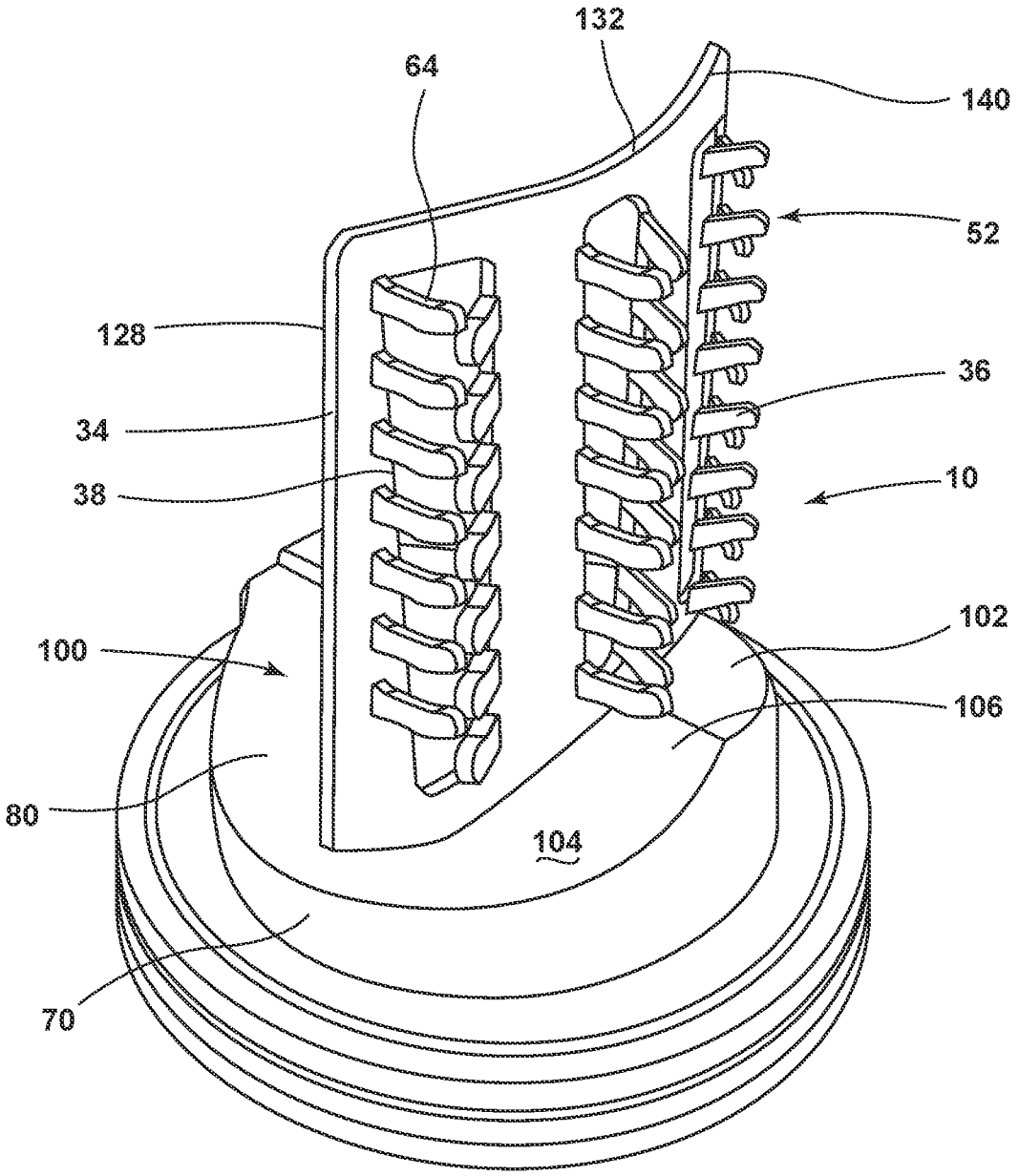
FIG. 8 is another perspective view of the button trap of FIG. 7.

As exemplified in FIGS. 6-8, the various fingers 36 of the plurality of fingers 36 can define an arcuate shape that bends in the direction of the flow 62 of fluid 28 through the button trap 10. In an exemplary embodiment, it is contemplated that the elongated body 34 of the button trap 10 can include three separate apertures 38. As discussed above, each of these apertures 38 can include opposing sets 52 of fingers 36 that extend to the centerline 50 of each respective aperture 38. It is contemplated that the various sets of opposing fingers 36 can also extend beyond the centerline 50 to form intersecting sets of fingers 36. In various aspects of the device, each of the opposing sets 52 of fingers 36 can extend toward the centerline 50, but may not reach the centerline 50 such that an elongated space within the aperture 38 may exist between the opposing sets 52 of fingers 36. The exact configuration of the elongated fingers 36 within the various apertures 38 of the button trap 10 can vary depending upon the configuration of a particular appliance 14 and the desired flow 62 of fluid 28 that is designed for the particular appliance 14 through the button trap 10.

Referring again to FIGS. 3-8, the button trap 10 can include a base 70 that is disposed within a trap receptacle 72 of the trap housing 12. This base 70 can be rotationally or threadingly disposed within the trap receptacle 72. In various aspects of the device, the base 70 can include an orienting feature 74 that rotationally locates the elongated body 34 and the various apertures 38 within the trap housing 12. This locating feature defined within the base 70 of the button trap 10 can engage a portion of the trap receptacle 72 to properly align the button trap 10 within the trap housing 12.

Figure 5:
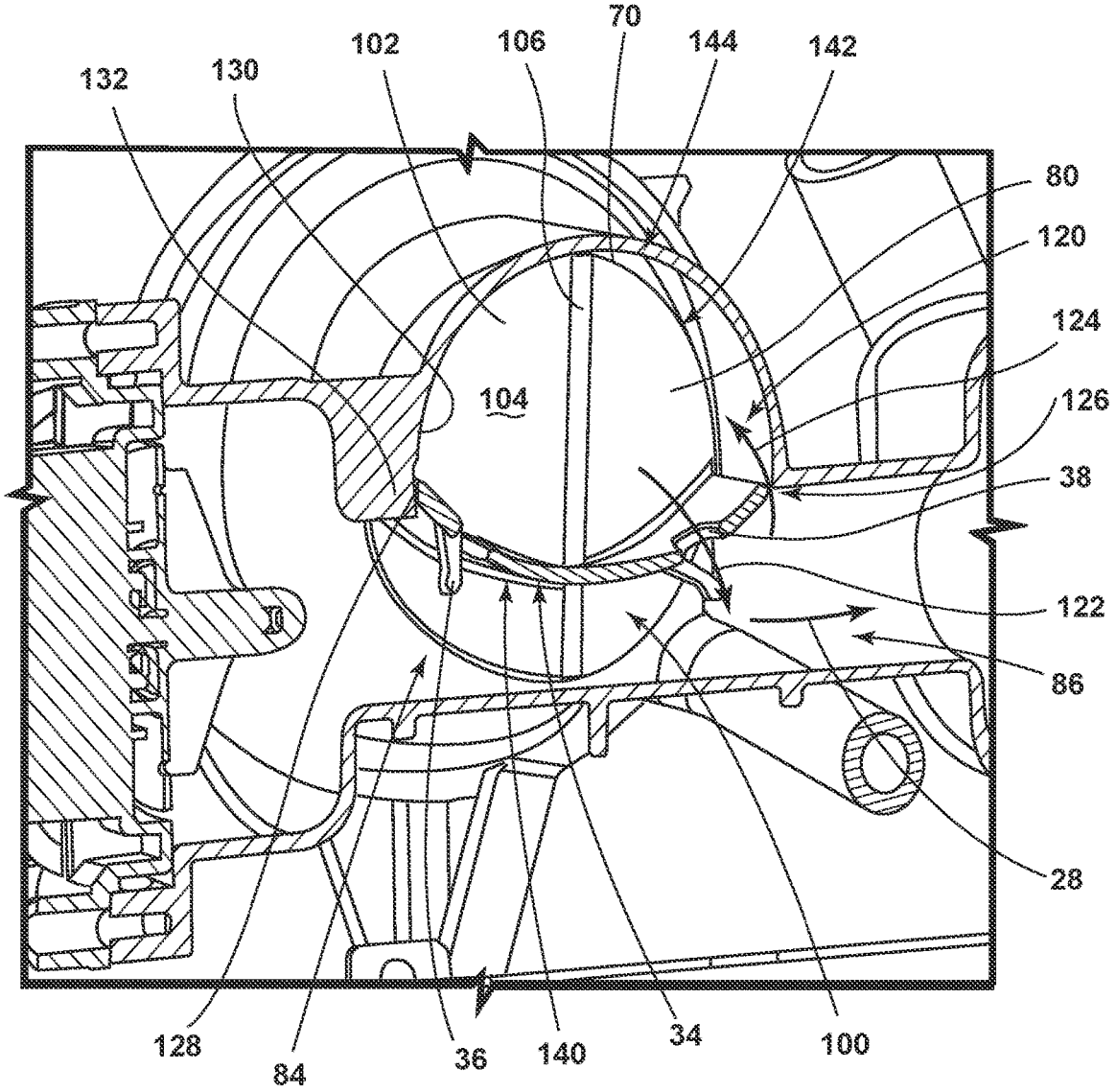
FIG. 5 is a cross-sectional perspective view of the trap housing taken through the elongated body of the button trap.

As exemplified in FIG. 5, the base 70 of the button trap 10 defines an inner wall 80. The elongated body 34 is configured to extend from this inner wall 80 and through the trap housing 12. During operation of the appliance 14, fluid 28 leaving the rotating drum 24 and the tub 20 is configured to enter the trap housing 12 through an inlet 82. This inlet 82 typically opposes the inner wall 80 of the base 70 for the button trap 10. As the fluid 28 enters into the trap housing 12, the fluid 28 is directed through the button trap 10. More specifically, the fluid 28 typically enters into each of the apertures 38 and between the various fingers 36 that are defined within each aperture 38.

The trap housing 12 can include a sediment zone 84 that is positioned below a water level within the trap housing 12. The sediment zone 84 is also positioned at least partially below the elongated body 34. Accordingly, the fine particulate material 18 is able to pass through the various apertures 38 and the various fingers 36 within the apertures 38, such that this particulate material 18 can move through the trap housing 12 and into the sediment zone 84 below the elongated body 34. Flanking the elongated body 34 of the button trap 10 are one or more flow outlets 86 that can lead to respective fluid pumps 30.

As exemplified in FIG. 5, the trap housing 12 can be in communication with two separate flow outlets 86. These flow outlets 86 can lead to separate fluid pumps 30 in the form of a recirculation pump 90 and an outlet pump 92. The recirculation pump 90 is configured to receive fluid 28 from the trap housing 12, along with the particulate material 18, and recirculate this fluid 28 back through the appliance 14 for reuse. The opposing flow outlet 86 can lead to a separate outlet pump 92. This outlet pump 92 is configured to deliver the fluid 28 from the trap housing 12 and transport this fluid 28 to an outlet 86, storage tank, or other area of the appliance 14 for disposal.

Referring again to FIGS. 3-8, the inner wall 80 that is defined by the base 70 of the button trap 10 can include a generally curved profile 100. This generally curved profile 100 can include opposing curves 102 that can be used to assist in the flow 62 of fluid 28 from the tub 20 and towards one or both of the recirculation pump 90 and the outlet pump 92. The curved profile 100 of the inner wall 80 can be in the form of opposing and diverging surfaces 104 that extend from a central ridge 106 defined within the base 70 of the button trap 10. As fluid 28 from the tub 20 moves into the trap housing 12, fluid 28 is directed from the central ridge 106 and toward the opposing and diverging surfaces 104 of the curved profile 100. The opposing curves 102 can assist in directing the fluid 28 towards one of the fluid pumps 30, respectively. Again, these fluid pumps 30 can take the form of a recirculation pump 90 and an outlet pump 92.

Referring again to FIGS. 3-8, in addition to directing the flow 62 of fluid 28 toward the flow outlets 86 and toward the fluid pumps 30, the curved profile 100 of the inner wall 80 also cooperates with the elongated body 34 to allow for the convenient movement of air 120 within the trap housing 12. As fluid 28 moves through the trap housing 12 and in a generally downward direction 122 through the apertures 38 of the elongated body 34, air 120 moves in a generally upward direction 124 and through opposing flow restriction spaces 126. These flow restriction spaces 126 are defined between outer edges 128 of the elongated body 34 and the inside surface 130 of the trap housing 12. The flow restriction spaces 126 are typically positioned above the apertures 38 in relation to the trap housing 12. This configuration allows for the upward flow of air 120 to an airspace 142.

As fluid 28 moves generally downward through the apertures 38 and between the various sets of fingers 36 defined therein, air 120 is displaced within the trap housing 12. This air 120 is directed upward and through the upwardly convex shape 140 of the elongated body 34 and the flow restriction space 126 that is defined around the outer perimeter 132, or portions of the outer perimeter 132 of the elongated body 34 for the button trap 10. Through this configuration of the elongated body 34, fluid 28 moves through the apertures 38 within a central portion of the elongated body 34 and air moves through the flow restriction spaces 126. Accordingly, fluid 28 and air 120 move through separate paths to allow for the efficient movement of fluid 28 in a generally downward direction 122. Again, the flow restriction spaces 126 allow for displaced air 120 to be moved in a generally upward direction 124 and toward an airspace 142 positioned near the curved profile 100 of the inner wall 80 for the button trap 10. The movement of air 120 in a generally upward direction 124 also prevents movement of air 120 through the fluid pumps 30. Air 120 within the fluid pump 30 can, in certain instances, cause damage to the fluid pump 30. By retaining this air 120 above the elongated body 34 and proximate the curved profile 100 of the inner wall 80, air 120 is prevented from entering into the sediment zone 84 below the elongated body 34 and toward the fluid pumps 30. The air 120 that collects within the airspace 142 of the trap housing 12 is positioned near the curved profile 100 of the inner wall 80 and typically toward a top portion 144 of the trap housing 12.

Referring again to FIGS. 1 and 3-8, the appliance 14 that incorporates the button trap 10 within the trap housing 12 described herein can be in the form of a horizontal axis laundry appliance 14 that includes the rotating drum 24 that operates within the tub 20. During operation of the appliance 14, fluid 28 and other chemistry fills within the tub 20 for treating laundry therein. This fluid 28 is removed from the tub 20 via an outlet 86 that can lead to one or more fluid pumps 30.

In order to prevent larger items, such as foreign objects 16, from damaging the fluid pumps 30, the button trap 10 is removably positioned upstream of the outlets 86 for the trap housing 12. The inlet 82 for fluid 28 entering the trap housing 12 from the tub 20 is typically positioned above the elongated body 34 for the button trap 10 such that fluid 28 entering into the trap housing 12 can move in a generally downward direction 122 through the apertures 38 for the button trap 10. The button trap 10 is inserted into the trap receptacle 72 for the trap housing 12. The button trap 10 includes a plurality of fingers 36 that are configured to capture and retain foreign objects 16 from moving past the outlet 86 and past the trap housing 12. The button trap 10 prevents these foreign objects 16 from proceeding toward the impeller 150 of the various fluid pumps 30 included within the appliance 14.

Particulate material 18, such as entrapped lint that is contained within the fluid 28, is allowed to freely pass through the plurality of fingers 36 so as not to clog the button trap 10 during operation of the appliance 14.

The button trap 10 includes an outwardly extending elongated body 34 or flange that includes at least one aperture 38 extending therethrough. The plurality of fingers 36 are attached to the elongated body 34 and are positioned to extend at least partially across each of the apertures 38 defined within the elongated body 34. In this manner, the fingers 36 are adapted to capture foreign objects 16 moving through the inlet 82 and through the trap housing 12. The outwardly extending elongated body 34 can include the plurality of apertures 38. Each aperture 38 typically includes opposing sets 52 of fingers 36 that extend across a portion of at least each aperture 38. The opposing sets 52 of fingers 36 are adapted to extend at least partially across the centerline of each aperture 38 to form a set of intermingled tynes that prevent the passage of larger foreign objects 16.

Referring again to FIGS. 3-8, in order to allow for the free, or substantially free, flow 62 of particulate material 18, such as lint particles, that are entrapped within the fluid 28, to pass through the apertures 38 and the fingers 36, the opposing sets 52 of fingers 36 extend generally in the direction of the flow 62 of fluid 28 through the apertures 38. When the particulate material 18 engages one or more of the fingers 36, the flow 62 of the fluid 28 can easily cause the material to quickly slide off the angled or arcuate surface 64 of the fingers 36 and move toward a fluid pump 30. The opposing sets 52 of fingers 36 can include a generally arcuate configuration or angled configuration to promote the sliding movement of the particulate material 18 off from each of the fingers 36 and with the flow 62 of fluid 28 to the fluid pump 30 or fluid pumps 30. This configuration of the various fingers 36 prevents accumulation of particulate material 18 on the button trap 10. By preventing the accumulation of particulate material 18 on the fingers 36 of the button trap 10, cleaning of the button trap 10 can be performed occasionally to remove foreign objects 16 from the trap housing 12.

Referring again to FIGS. 3-8, the curved profile 100 of the inner wall 80 for the base 70 of the button trap 10 can include opposing ramped and diverging surfaces 104 that are positioned to be generally perpendicular to the outwardly extending elongated body 34. The opposing ramped and diverging surfaces 104 help to direct the flow 62 of fluid 28 from the inlet 82 for the trap housing 12 and through the various apertures 38. This flow 62 of fluid 28 that is at least partially directed by the opposing diverging surfaces 104 helps to move the fluid 28 toward the various fluid pumps 30.

Referring again to FIGS. 3-8, the flow restriction spaces 126 can be located between the trap housing 12 that forms the receptacle for the button trap 10 and the outer edges 128 of the outwardly extending elongated body 34. These flow restriction spaces 126 allow air 120 to be displaced upward and above the elongated body 34 while fluid 28 moves in a generally downward direction 122 and through the various apertures 38 within the elongated body 34. As the fluid 28 moves downward, the air 120 moves upward and round the upwardly convex shape 140 of the elongated body 34 and through the flow restriction spaces 126. This displaced air 120 accumulates as bubbles of air 120 near the opposing diverging surfaces 104 of the inner wall 80 for the button trap 10.

The use of the button trap 10 described herein is configured to provide for the free or substantially free flow 62 of fluid 28 and particulate material 18 through the outlet 86 for the trap housing 12 and through each impeller 150 of the various fluid pumps 30. The button traps 10 are typically configured to capture larger, solid objects such as coins, pen caps, and other larger objects that are frequently left within laundered clothing contained within the laundry appliance 14. According to various aspects of the device, the button trap 10 disclosed herein can be used within the various appliances 14. Such appliances 14 can include, but are not limited to, washers, dryers, combination washers and dryers, dishwashers, and other similar appliances 14 where water is moved through a fluid system for the particular appliance 14.

According to another aspect of the present disclosure, a laundry appliance includes a wash tub disposed within a cabinet. A rotating drum is disposed within the wash tub. A drain system directs a fluid from the wash tub to a fluid pump. A trap is disposed within a tub drain of the wash tub. The trap includes an elongated body having a plurality of fingers that extend across an aperture defined within the elongated body. The plurality of fingers are configured to permit passage of particulate material and prevent passage of foreign objects through the elongated body.

According to another aspect, the plurality of fingers extends across a centerline of the aperture.

According to yet another aspect, the plurality of fingers includes opposing sets of fingers that each extend across the centerline of the aperture.

According to another aspect of the present disclosure, the plurality of fingers extends in a direction along a flow of fluid through the trap and toward the fluid pump.

According to another aspect, the plurality of fingers defines a generally arcuate shape that prevents trapping of fine particulate material and simultaneously prevents passage of foreign objects that are within the tub drain.

According to yet another aspect, the trap includes a body that is disposed within a trap receptacle, the body defining an inner wall from which the elongated body extends.

According to another aspect of the present disclosure, the inner wall includes a generally curved profile that directs air bubbles in a generally upward direction as fluid from the tub moves in a generally downward direction through the aperture and the plurality of fingers.

According to another aspect, the elongated body and a trap housing define a flow restriction space. The flow restriction space restricts a flow of fluid and simultaneously allows an upward flow of air up to an airspace positioned at the inner wall of the trap.

According to yet another aspect, the trap housing includes a sediment zone that is below a water level within the trap housing.

According to another aspect of the present disclosure, the aperture of the trap is positioned above the sediment zone.

According to another aspect, a flow outlet of the trap housing is positioned below the elongated body, wherein the flow outlet includes at least one outlet to a fluid pump.

According to yet another aspect, the flow outlet includes opposing flow outlets that lead to opposing pumps that include a recirculation pump and an outlet pump.

According to another aspect of the present disclosure, a laundry appliance includes a wash tub disposed within a cabinet and having a rotating drum positioned therein. A drain system directs a fluid from the wash tub to a fluid pump. A tub drain directs fluid from the wash tub to a fluid pump system. A foreign-object trap is disposed within the tub drain. The foreign-object trap includes an elongated body and a plurality of fingers that extend in a direction of a flow of fluid through the foreign-object trap. The plurality of fingers are configured to permit passage of particulate material toward the pump system and prevent passage of foreign objects through the elongated body.

According to another aspect, the elongated body includes at least one aperture, wherein the plurality of fingers extend at least partially across the at least one aperture.

According to yet another aspect, the elongated body includes a plurality of apertures, and each aperture of the plurality of apertures includes opposing sets of fingers.

According to another aspect of the present disclosure, the opposing sets of fingers extend across a centerline of respective apertures of the plurality of apertures.

According to another aspect, the opposing sets of fingers each extend across the centerline of the respective apertures.

According to yet another aspect, a laundry appliance includes a wash tub disposed within a cabinet and having a rotating drum positioned therein. A drain system directs a fluid from the wash tub to a fluid pump. A tub drain directs fluid from the wash tub to a fluid pump system. A foreign-object trap is disposed within the tub drain. The foreign-object trap includes an elongated body and a plurality of apertures that permit passage of particulate material toward the pump system and prevent passage of foreign objects through the elongated body. The elongated body defines a flow restriction space that permits upward movement of air as fluid moves through the plurality of apertures and toward the fluid pump system.

According to another aspect of the present disclosure, the flow restriction space is defined between the elongated body and a trap housing of the tub drain.

According to another aspect, a plurality of fingers extend across a centerline of each respective aperture of the plurality of apertures. Each finger of the plurality of fingers defines a generally arcuate shape that prevents trapping of fine particulate material and simultaneously prevents passage of foreign objects that are within the tub drain.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A drain system for an appliance, the drain system comprising:

a drain;

a fluid pump system, wherein the fluid pump system operates to direct fluid from the drain and to a flow outlet; and a trap disposed within the drain, wherein the trap includes an elongated body having an upward convex shape and that surrounds an aperture defined within the elongated body, wherein the trap further includes a plurality of fingers that extend partially across the aperture, wherein the plurality of fingers diverge from the upward convex shape of the elongated body and slope in a generally downward direction and toward the flow outlet to permit passage of particulate material and prevent passage of foreign objects through the elongated body.

2. The drain system of claim 1, wherein the aperture is defined within and is entirely surrounded by the elongated body, and wherein the plurality of fingers extends across a centerline of the aperture.

3. The drain system of claim 1, wherein the plurality of fingers includes opposing sets of fingers that each extend across a centerline of the aperture.

4. The drain system of claim 1, wherein the plurality of fingers extends into an area below the elongated body and in a direction along a flow of the fluid through the trap and toward the flow outlet and the fluid pump system.

5. The drain system of claim 1, wherein the plurality of fingers defines a generally arcuate shape that prevents trapping of fine particulate material and simultaneously prevents passage of foreign objects that are within the drain.

6. The drain system of claim 1, wherein the trap includes a body that is disposed within a trap receptacle of the drain, the body defining an inner wall from which the elongated body extends.

7. The drain system of claim 6, wherein the inner wall includes a generally curved profile that directs air bubbles in a generally upward direction as the fluid moves in a generally downward direction through the aperture and the plurality of fingers.

8. The drain system of claim 7, wherein a trap housing of the drain cooperates with outer edges of the elongated body to define a flow restriction space, wherein the flow restriction space restricts a downward flow of fluid around the elongated body and contemporaneously allows an upward flow of air around the elongated body up to an airspace positioned at the inner wall of the trap.

9. The drain system of claim 8, wherein the trap housing includes a sediment zone that is below a water level within the trap housing.

10. The drain system of claim 9, wherein the aperture of the elongated body is positioned above the sediment zone.

11. The drain system of claim 8, wherein the flow outlet is positioned below the elongated body, wherein the flow outlet includes at least one outlet to the fluid pump system.

12. The drain system of claim 11, wherein the flow outlet includes opposing flow outlets that lead to a recirculation pump and an outlet pump, respectively, of the fluid pump system.

13. A drain system for an appliance, the drain system comprising:

a drain having a trap housing;

a fluid pump system, wherein the fluid pump system operates to direct fluid from the drain and to a flow outlet; and a foreign-object trap disposed within the trap housing, the foreign-object trap including an elongated body having an upward convex shape and a plurality of fingers that extend in a direction of a flow of fluid through the foreign-object trap that diverge from the upward convex shape and slope in a generally downward direction toward the flow outlet that leads to the fluid pump system to permit passage of particulate material toward the fluid pump system and prevent passage of foreign objects through the elongated body.

14. The drain system of claim 13, wherein the elongated body includes at least one aperture, wherein the plurality of fingers extend at least partially across the at least one aperture.

15. The drain system of claim 13, wherein the elongated body includes a plurality of apertures, and wherein each aperture of the plurality of apertures includes opposing sets of fingers.

16. The drain system of claim 15, wherein the opposing sets of fingers extend across a centerline of the respective apertures of the plurality of apertures.

17. The drain system of claim 16, wherein the opposing sets of fingers each extend across the centerline of the respective apertures.

18. A drain system for an appliance, the drain system comprising:

a drain having a trap housing;

a fluid pump system that directs fluid from the drain and to a flow outlet; and a foreign-object trap disposed within the trap housing, the foreign-object trap including an elongated body having outer edges and a plurality of internal apertures that are surrounded by the elongated body and that permit passage of particulate material toward the fluid pump system and prevent passage of foreign objects through the elongated body, wherein the elongated body includes an upwardly convex shape that slopes upward from the plurality of internal apertures to the outer edges of the elongated body; and the outer edges of the elongated body define a flow restriction space that permits upward movement of air as the fluid moves through the plurality of internal apertures and toward the flow outlet.

19. The drain system of claim 18, wherein the flow restriction space is defined between the outer edges of the elongated body and the trap housing.

20. The drain system of claim 18, further comprising:

a plurality of fingers that extend across a centerline of each respective aperture of the plurality of internal apertures, and wherein each finger of the plurality of fingers defines a generally arcuate shape that slopes in a generally downward direction that prevents trapping of fine particulate material and simultaneously prevents passage of foreign objects that are within the drain.

* * * * *